United States Patent [19]

Valo

[11] 4,201,257

[45] May 6, 1980

[54] TIMBER PROCESSING MACHINE

[76] Inventor: Antti T. Valo, P.O. Box 29, 08100 Lohja 10, Finland

[21] Appl. No.: 871,905

[22] Filed: Jan. 24, 1978

[30] Foreign Application Priority Data

Mar. 18, 1977 [FI] Finland ..... 770860

[51] Int. Cl.[2] ..... B27L 1/00

[52] U.S. Cl. ..... 144/208 E; 144/2 Z

[58] Field of Search ..... 144/2 Z, 208 R, 208 E, 144/311

[56] References Cited

U.S. PATENT DOCUMENTS

| | | | |
|---|---|---|---|
| 3,329,184 | 7/1967 | Longert | 144/2 Z |
| 4,074,738 | 2/1978 | Valo | 144/208 E |

FOREIGN PATENT DOCUMENTS

| | | | |
|---|---|---|---|
| 2212158 | 9/1972 | Fed. Rep. of Germany | 144/311 |
| 1117859 | 3/1967 | United Kingdom | 144/208 R |
| 192542 | 2/1967 | U.S.S.R. | 144/208 E |
| 512065 | 4/1976 | U.S.S.R. | 144/208 E |
| 512069 | 4/1976 | U.S.S.R. | 144/208 E |

*Primary Examiner*—Robert Louis Spruill
*Assistant Examiner*—W. D. Bray
*Attorney, Agent, or Firm*—Ladas, Parry, Von Gehr, Goldsmith & Deschamps

[57] ABSTRACT

A timber processing machine comprising a hollow rotor provided with barking and lopping knives. A tree trunk to be processed is fed longitudinally through the rotor. A non-rotable guide ring is coaxially fastened to the rotor at the inlet side of the knives. The front edge of the knives is sharpened along that portion of the knives which extends radially inside the guide ring. Said guide ring forces the branches of the tree trunk fed into the rotor to be bent into positions in parallel with the tree trunk and the knives cut the bent branches into pieces as the trunk is fed through the rotor.

7 Claims, 4 Drawing Figures

Figure 1:
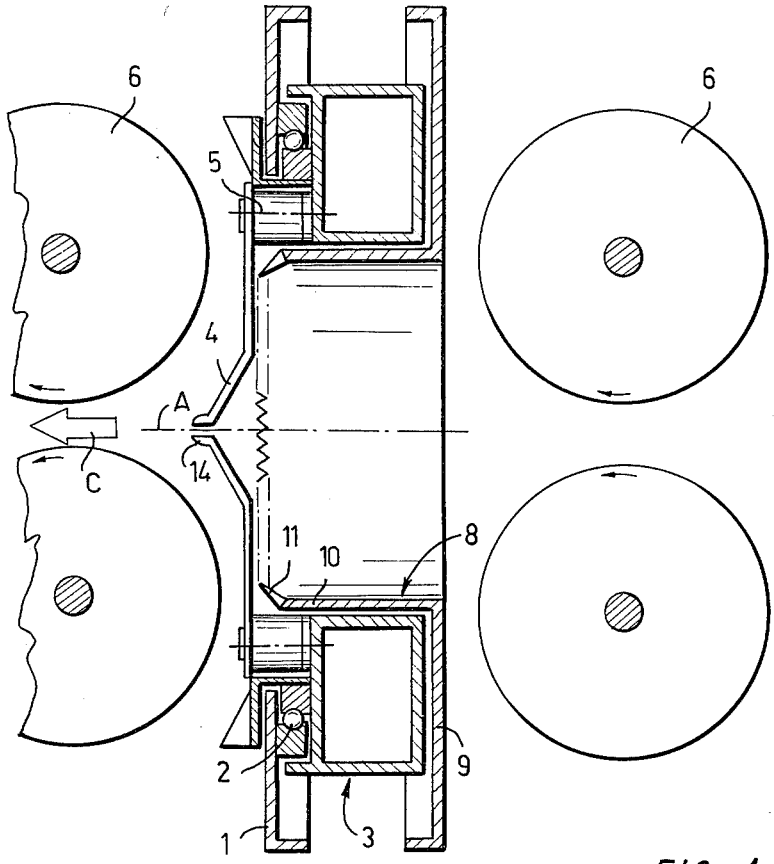

FIG. 2
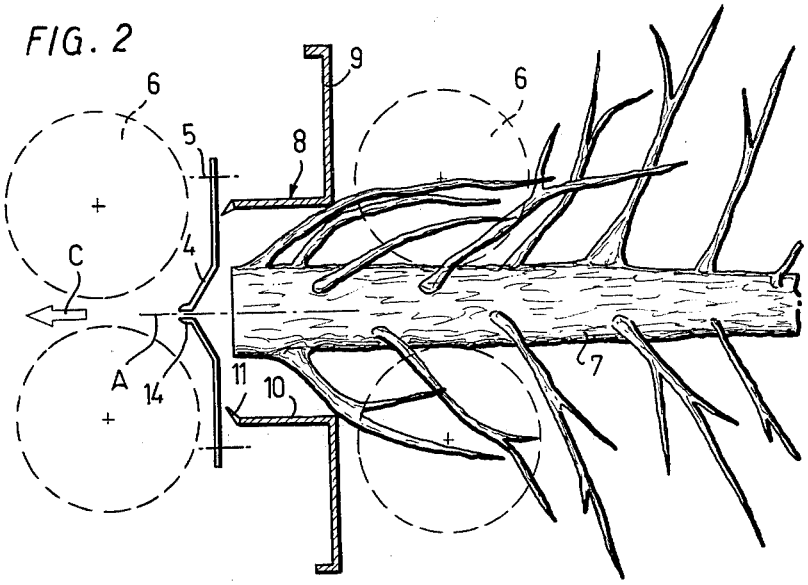
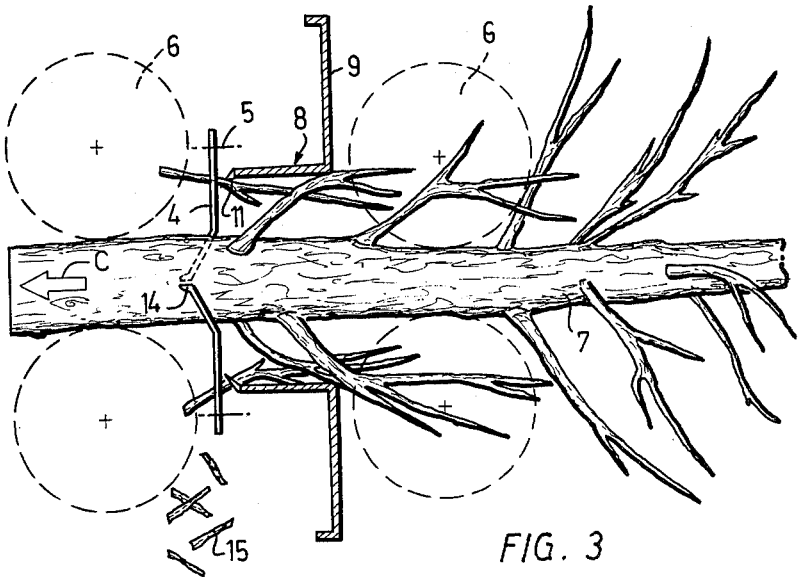
FIG. 3

TIMBER PROCESSING MACHINE

The subject of the present invention is a timber processing machine which comprises a hollow rotor rotably mounted in a frame, through which rotor a tree trunk to be processed is fed longitudinally, barking and lopping knives journalled pivotally on the rotor and directed towards the centre of the rotor, and means for feeding the tree trunk to be processed through the hollow rotor.

It is a previously known procedure to provide the tips of the barking knives of a barking machine of the hollow-rotor type with additional blades so as to cut off the branches on the tree trunk before the trunk is barked when the trunk is fed through the hollow rotor. In this way the machine operates as a combined lopping and barking machine so that an unlopped tree trunk can be both lopped and barked during one running through. Thus, in a machine of this type, the branches are cut off at their bases and can thereupon fall off the tree trunk. To-day, attempts are, however, made also to recover the branches especially for firewood purposes, and this is why the branches must be collected and cut into chips in a particular cutter machine. This is, however, laborious and time-consuming and requires special machinery with drive units of their own.

An object of the present invention is to eliminate the above drawback and to provide a timber processing machine that does not only perform the lopping and barking of the tree trunk which also cuts the branches into pieces. The invention is based on the idea that the branches are forced to bend against the tree trunk and the trunk-branch package is then fed longitudinally through the hollow rotor and that the knives are designed so that, besides barking and lopping, they also cut off pieces of the branches at every revolution of the rotor. This purpose is achieved by means of the machine in accordance with the present invention, which is includes:

- a non-rotable guide ring surrounding the path of movement of the tree trunk to be processed arranged on the inlet side of the knives of the hollow rotor so as to force the branches to bend themselves parallel with the tree trunk when the trunk is fed through the guide ring and the hollow rotor, and
- that in the direction of rotation of the knives, the front edge is shaped as a cutting edge at least on the portion of the blade that extends radially inside the guide ring so as to cut the branches fed through the guide ring into pieces.

In accordance with the invention, a machine of a simple construction and operation is obtained, and the additional equipment required can in a simple way be mounted on the hollow-rotor type barking machines at present in use. As the roller means for feeding the tree trunk through the hollow rotor push as an unlopped tree trunk through the stationary guide ring, this ring forces the branches to bend themselves and to assume a position substantially parallel to the trunk around the trunk. When the trunk is fed further towards the knives, the branches are cut off at their roots by the blades, while the branches in this way cut off remain in position around the trunk as held by the guide ring surrounding the branches. When the tree trunk moves forwards, the branches follow along with same partly conveyed by branches still fixed on the trunk and partly by said feeding roller means. When the knives rotate together with the rotating rotor around the nonrotable package of branches, the knives cut off branches on every revolution of the rotor. Depending on the number of knives, each branch is cut once or several times per revolution of the rotor so that the branches can be cut into longer or shorter pieces. When the tree trunk moves through the hollow rotor, it is barked in the ordinary way.

From barking machines developed for barking trees with longfibred bark, it is previously known to mount a stationary tubular mantle inside the hollow rotor. However, the purpose of such a mantle is with its end edge to collaborate with the blades in order to cut long bark strips which are readily produced. The machine is not suitable for barking unlopped tree trunks, and the knives are ordinary barking knives with sharpened tips.

It is another known procedure, previously known barking machines, to provide the front edges of the knives with sharp angles, but the purpose of this operation is only to permit the knife to rise onto the surface of the tree trunk at the beginning of barking when the end of the trunk is pressed against the knives. Once the knives have risen onto the tree trunk, said front edges of the knives are completely inoperative. The machine is not suitable for barking unlopped tree trunks, nor have said front edges of the knives been ground suitable for cutting operation.

In order that the branches that have already been detached from the tree trunk should not start rotating with the knives cutting them, it is preferable that the circumferential edge of the guide ring that faces towards the knives is provided with one or more teeth which project diagonally in the feeding direction of the trunk and towards the rotor axis and are directed against the direction of rotation of the rotor. In this way the detached branches are forced into the mouth formed by these teeth as pushed by the cutting knives and the branches can be cut reliably.

Figure 4:
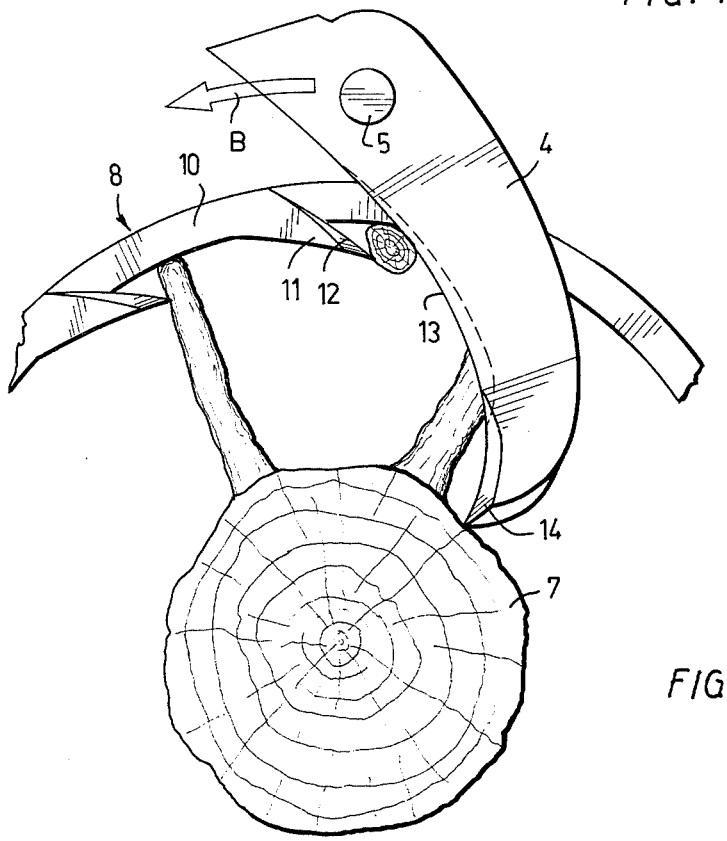

The invention will now be described, by way of example with reference to the attached drawings, wherein FIG. 1 is a schematical sectional elevation of preferred embodiment of the timber processing machine in accordance with the invention FIGS. 2 and 3 illustrate the operation of the machine in two different positions of the tree trunk, and FIG. 4 shows an enlarged view of one knife and a section of the guide ring as viewed in the axial direction.

The timber processing machine shown in the drawings comprises a stationary frame 1, which, by means of the bearing 2, supports a rotor 3, which rotates around a horizontal axis A of rotation. On the rotor 3, a number of barking and lopping knives 4 are pivotally journalled on pivot shafts 5, which are parallel with the axis of rotation of the rotor. Feeding rollers 6 are arranged on the inlet and outlet sides of the rotor. The tree trunk 7 to be barked and lopped is passed axially through the rotor in the direction of the arrow C.

According to the invention, the suggested machine is provided with a guide ring 8, which is non-rotably fastened on the frame 1 of the machine coaxially with the rotor by means of a support 9, which supports a tubular mantle 10 extending into the opening of the hollow rotor from the inlet side of same, the front edge of which tubular mantle extends close to the plane of rotation of the knives 4, as appears from FIG. 1. The annular front edge of the tubular mantle is provided with holding and cutting teeth 11 placed at mutual distances, said teeth being in the axial section of the rotor (FIG. 1) directed diagonally inwards towards the rotor axis and in the direction C of feeding of the tree trunk and in the radial view (FIG. 4) directed diagonally against the direction B of rotation of the rotor. The teeth are provided with sharp inner edges 12.

According to the invention, the front edge of the knives 4, in the direction of rotation of the knives, is shaped as a cutting edge 13 on the portion of the knife that extends radially inside the mantle 10 of the guide ring. The inner ends of the knives are provided with combined barking and lopping tips 14.

The machine operates as follows:

When the tree trunk 7 with its branches is fed by means of the rollers 6 into the rotor opening, the branches toss against the guide ring 8, whereby the branches are bent and assume a position parallel with the trunk when the rollers force the tree trunk forwards. The branches occuring at the rollers are already partly pressed against the trunk by the rollers.

When the tree trunk meets knives rotating together with the rotor, the knives rise onto the trunk and start barking the trunk and lopping branches at their roots. The branches are pressed by the guide ring into a "package" around the trunk, and the detached branches are thereby prevented from falling off. Partly as pulled by the trunk and partly as pushed by the rollers, the package of branches is forced to pass through the hollow rotor. During each revolution, the constantly rotating knives subject the branches to a cutting effect by means of the sharpened edges 13 of the knives so that the branches are cut into pieces 15 of desired length. Owing to the teeth 11 at the front edge of the guide ring, the branches cannot rotate in the guide ring as pushed by the knives, but the branches end up in a mouth formed by the teeth (FIG. 4), wherein they are cut off by means of the joint effect of the knife and the tooth.

It is noticed that by one running-through of the tree trunk the trunk can be barked and lopped and the branches be cut into pieces.

The drawings and the related description are only intended to illustrate the idea of the invention. In its details, the timber processing machine in accordance with the invention may show even considerable variation within the scope of the patent claim. If the rotor is of a type in which the knives are mounted on the inlet side of the rotor and not on the outlet side of same, the guide ring is mounted on the inlet side of the knives, in which case the guide ring remains outside the rotor. Especially in the case of trees with thin branches, it is possible that the front edge of the knives is not sharpened into a cutting edge 13 but is blunt, in which case the knife just pushes the branch into the mouth of the guide ring tooth 11 and the sharp edge 12 of the tooth performs the cutting off of the branch as pressed by the knife. In stead of teeth 11, the guide ring can be provided, e.g., with ribs or equivalent means fastened to the inside face of the mantle, which means prevent rotation of the branches in the guide ring with the knives.

What we claim is:

1. A timber processing machine which comprises a frame, a hollow rotor rotably mounted in said frame, through which rotor a tree trunk to be processed is to be fed longitudinally, barking and lopping knives journalled pivotally on the rotor and directed towards the center of the rotor, feeding means for feeding the tree trunk to be processed longitudinally through the hollow rotor, a non-rotatable guide ring surrounding the path of movement of the tree trunk to be processed arranged on the inlet side of the knives of the hollow rotor to bend branches projecting from the tree trunk parallel with the tree trunk as the tree trunk is fed, by the feeding means, through the guide ring and the hollow rotor, the leading edge of each knife being a cutting edge at least on the portion of the blade that extends radially inside the guide ring, and wherein the circumferential edge of the guide ring adjacent the knives is provided with at least one tooth which projects diagonally in the direction of feed of the tree trunk, inwardly toward the rotor axis and in opposition to the direction of rotation of the rotor.

2. A machine as claimed in claim 1, wherein the tooth or teeth are each provided with a sharp cutting edge.

3. A machine as claimed in claim 1, wherein the guide ring is provided with fixed branch rotation preventing means projecting inwardly toward the rotor axis.

4. A machine as claimed in claim 1, wherein the guide ring consists of a tubular non-rotatable element.

5. A machine as claimed in claim 4, in which the knives are journalled on the rotor on its outlet side wherein said tubular guide extends into the opening of the rotor from its inlet side and extends from the inside of the opening until adjacent the plane or rotation of the knives.

6. A machine as claimed in claim 1, wherein the cutting edge of each knife extends from the tip thereof substantially to the journal point.

7. A timber processing machine which comprises a frame, a hollow rotor rotatably mounted in said frame, through which rotor a tree trunk to be processed is to be fed longitudinally, barking and lopping knives journalled pivotally on the rotor and directed towards the center of the rotor, feeding means for feeding the tree trunk to be processed longitudinally through the hollow rotor, a non-rotatable guide ring surrounding the path of movement of the tree trunk to be processed arranged on the inlet side of the knives of the hollow rotor to bend branches projecting from the tree trunk parallel with the tree trunk as the tree trunk is fed, by the feeding means, through the guide ring and the hollow rotor, the leading edge of each knife being a cutting edge at least on the portion of the blade that extends radially inside the guide ring, and wherein the guide ring is provided with fixed branch rotation preventing means projecting inwardly toward the rotor axis.

* * * * *